United States Patent [19]

Kawabata et al.

[11] 4,347,048

[45] Aug. 31, 1982

[54] HYDRAULIC PUMP FOR POWER STEERING

[75] Inventors: Minoru Kawabata; Susumu Honaga, both of Aichi; Yoshiharu Inaguma, Nagoya, all of Japan

[73] Assignee: Toyoda Koki Kabushiki Kaisha, Kariya, Japan

[21] Appl. No.: 186,843

[22] Filed: Sep. 15, 1980

[30] Foreign Application Priority Data

Sep. 26, 1979 [JP] Japan ..... 54/124982

[51] Int. Cl.[3] ..... F04B 49/02; F04B 49/08

[52] U.S. Cl. ..... 417/310

[58] Field of Search ..... 417/310, 300

[56] References Cited

U.S. PATENT DOCUMENTS 2,910,944 11/1959 Pettibone ..... 417/310 X
3,125,028 3/1964 Rohde ..... 417/310 X
3,207,077 9/1965 Zeigler et al. ..... 417/310 X
3,901,628 8/1975 Bornholt et al. ..... 417/310 X

*Primary Examiner*—Richard E. Gluck
*Attorney, Agent, or Firm*—Oblon, Fisher, Spivak, McClelland & Maier

[57] ABSTRACT

A vane type hydraulic pump for use in a power steering apparatus comprising a pump housing receiving therein a non-rotatable cam ring and non-rotatable but axially slidable pressure plate and subplate. A pump rotor rotatable integrally with a drive shaft is received in an internal cam bore of the cam ring and, when rotated, delivers pressurized fluid to a discharge port connected to the power steering apparatus. The pressure plate and subplate define at a contact portion therebetween a radial low pressure passage, which is fluidically communicated with an axial low pressure hole receiving fluid from a pump reservoir and bypassed fluid from a flow volume control valve. The radially outer portions of the low pressure passage are gradually curved in a direction of rotation of the pump rotor.

2 Claims, 6 Drawing Figures

HYDRAULIC PUMP FOR POWER STEERING

BACKGROUND OF THE INVENTION

1. Field of the Invention

The present invention relates to a hydraulic pump used together with an automotive power steering apparatus.

2. Description of the Prior Art

In a conventional hydraulic pump for use in a power steering apparatus, an intake hole communicating with a pump reservoir is arranged in separate relationship with a low pressure hole communicating with a flow control valve. Accordingly, pump suction efficiency is not completely sufficient. Furthermore, a drive shaft for rotating a pump rotor is supported by a pump housing and a pressure plate adjacent to the pump rotor. Therefore, the bearing bores formed in the pump housing and the pressure plate for the support of the drive shaft have to be machined in precisely coaxial relationship, and the thickness of the pressure plate has to be large with the result of a difficulty in a compact-sized hydraulic pump.

Furthermore, in the conventional hydraulic pump, a pump discharge port communicating with the power steering apparatus is communicated with the flow volume control valve in intersected relationship, so that the pump housing has to provide a projection to form the discharge port with the result of a difficulty in a compact-sized hydraulic pump.

SUMMARY OF THE INVENTION

It is therefore an object of the present invention to provide an improved hydraulic pump with high pump suction efficiency.

Another object of the present invention is to provide an improved hydraulic pump which is compact in size.

Briefly, according to the present invention, these and other objects are achieved by providing a hydraulic pump for use in a power steering apparatus, as mentioned below. A pump body has an inner bore. A support member is fixedly inserted into one open end of the inner bore of the pump body so as to constitute a pump housing. A cam ring is received in the inner bore in contact relationship with one side wall of the support member and has an internal cam bore. A drive shaft is rotatably carried by the support member through a pair of bearings and extends into the internal cam bore in coaxial alignment with the axis of the internal cam bore. A pump rotor is carried on the drive shaft for integral rotation therewith and received in the internal cam bore for defining a pump chamber. A plurality of vanes are radially slidably received in the pump rotor for contacting the internal cam bore. A pressure plate is received in the inner bore of the pump body in contact relationship with the cam ring for defining inlet port means fluidically communicated with an inlet area of the pump chamber and outlet port means fluidically communicated with an outlet area of the pump chamber. A subplate is received in the inner bore of the pump body in contact relationship with the pressure plate for defining at a contact portion with the pressure plate a low pressure passage extending in a radial direction and communicated with the inlet port means. The pump body is formed with a low pressure hole in coaxial relationship with the internal cam bore and communicated at one end thereof with the low pressure passage. The pump body is formed with a vertical intake hole communicated with the intermediate of the low pressure hole.

The subplate defines between itself and the pump body a pressure chamber fluidically communicated with the outlet port means of the pressure plate through the subplate. A spring is interposed within the pressure chamber for urging the subplate, pressure plate and cam ring toward the one side wall of the support member. The pump body is formed with a discharge passage in parallel relationship with the bypass hole and communicated at one end thereof with the pressure chamber and at the other end thereof with the valve bore. A throttle element is disposed on the discharge passage through which pressurized fluid from the pressure chamber is discharged to the power steering apparatus. A flow volume control valve is slidably received in the valve bore and responsive to the pressure difference across the throttle element for returning a part of pressurized fluid through the outlet passage, valve bore, low pressure hole and low pressure passage.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
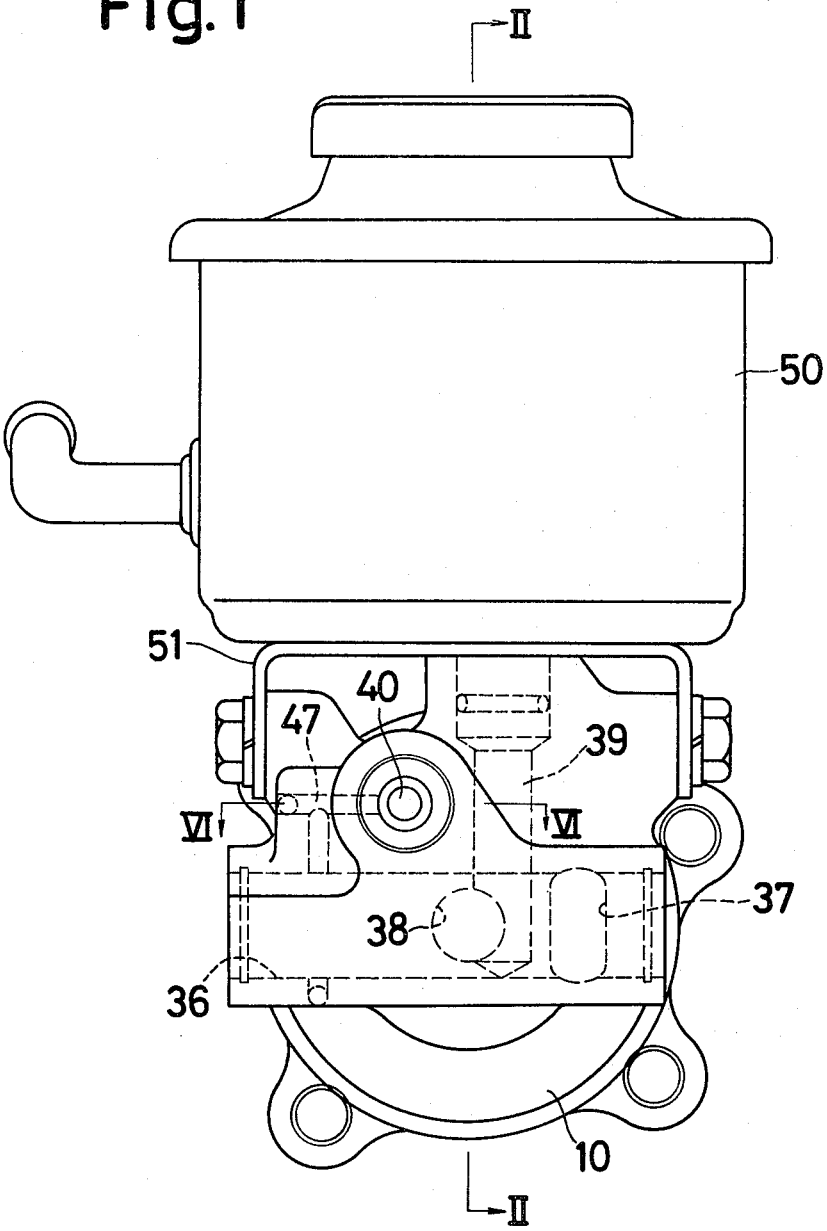
FIG. 1 is a side elevational view of a hydraulic pump for use in a power steering apparatus.
Figure 2:
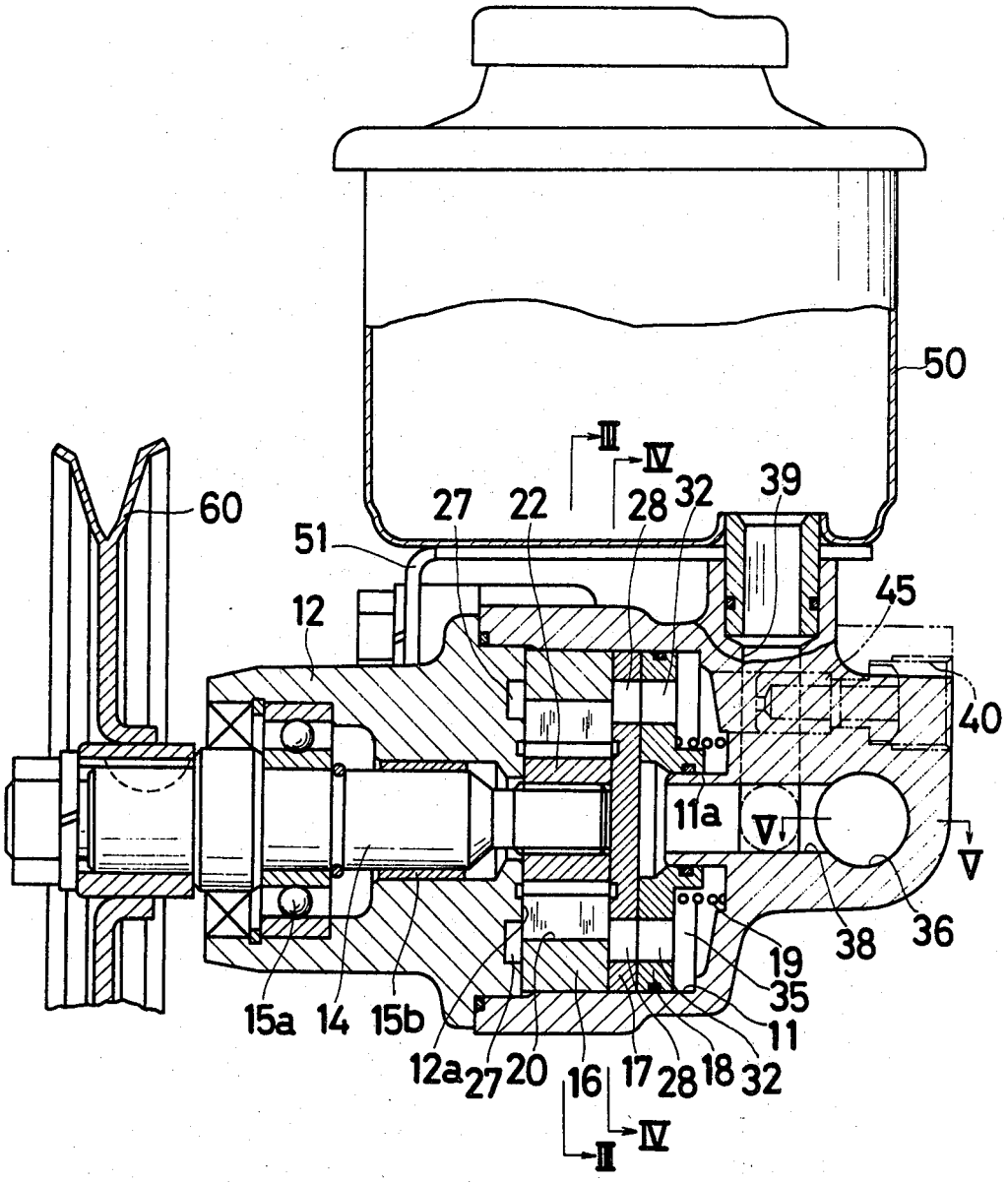
FIG. 2 is a sectional view taken along the lines II—II in FIG. 1.

Referring now to the drawings, where like reference numerals refer to identical or corresponding parts throughout the several views, and more particularly to FIGS. 1 and 2, there is shown a pump body 10, on which a support member 12 is fixedly inserted into one open end of the inner bore 11 of the pump body 10 so as to constitute a pump housing. A drive shaft 14 is rotatably carried by the support member 12 through bearings 15*a* and 15*b* and supports at its one end outside the support member 12 a pulley 60 which is connected through belts to an automotive engine, not shown, to be driven thereby.

A pressure plate 17 and a subplate 18 are slidably received in the inner bore 11 of the pump body 10 in juxtaposed contact relationship with each other. The subplate 18 is snugly fitted at its inner bore on a cylindrical sleeve portion 11*a* extended from the bottom wall of the inner bore 11 in coaxial relationship with the inner bore 11. A cam ring 16 is interposed between the pressure plate 17 and one side wall 12*a* of the support member 12 and is held in position by means of a plurality of pins, not shown, which extend through the subplate 18, the pressure plate 17, the cam ring 16 and the support member 12. A spring 19 is interposed between the bottom wall of the inner bore 11 and the subplate 18 to urge the subplate 18, the pressure plate 17 and the cam ring 16 toward the side wall 12*a* of the support member 12.

Figure 3:
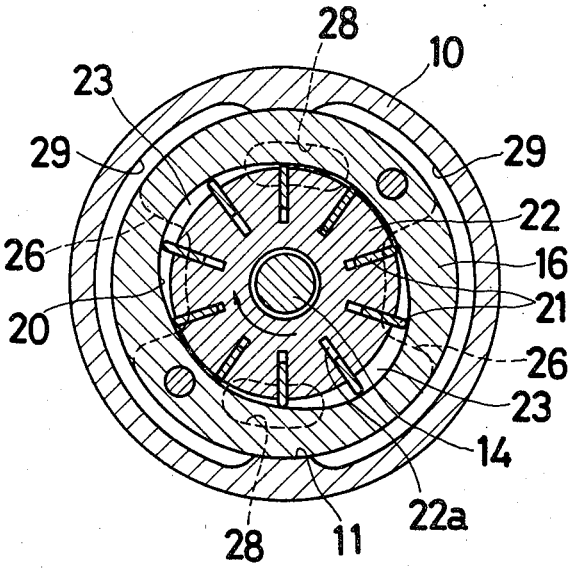
FIG. 3 is a sectional view taken along the lines III—III in FIG. 2.

The cam ring 16 is formed with an internal cam surface 20, as illustrated in FIG. 3, and within a space defined by the cam surface 20, the support member side wall 12*a* and the pressure plate 17 there is rotatably contained a pump rotor 22, which is carried on the drive shaft 14 through a spline connection therewith. Accordingly, the pump rotor 22, together with the cam surface 20 of the cam ring 16, define two crescent-shaped pump chambers 23 with an angular separation of 180 degrees. The pump rotor 22 is formed on its circumferential surface with a plurality of radial slots 22*a*, within which are slidably received respective vanes 21 contacting the cam surface 20 of the cam ring 16. These vanes 21 separate each pump chamber 23 into a plurality of sealed chambers.

Figure 4:
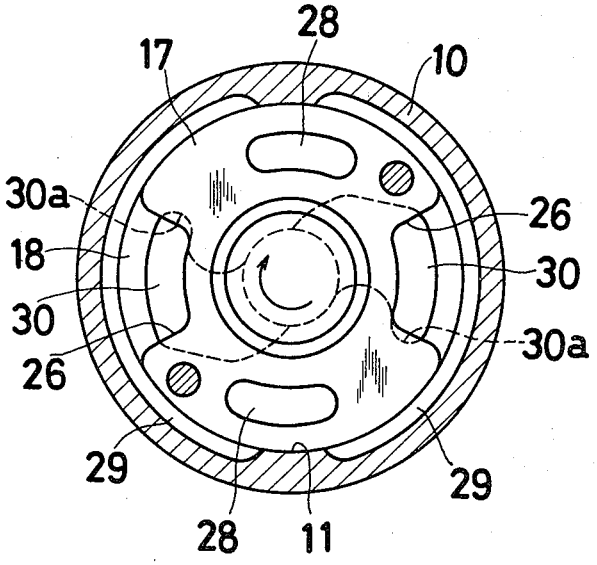
FIG. 4 is a sectional view taken along the lines IV—IV in FIG. 2.
Figure 5:
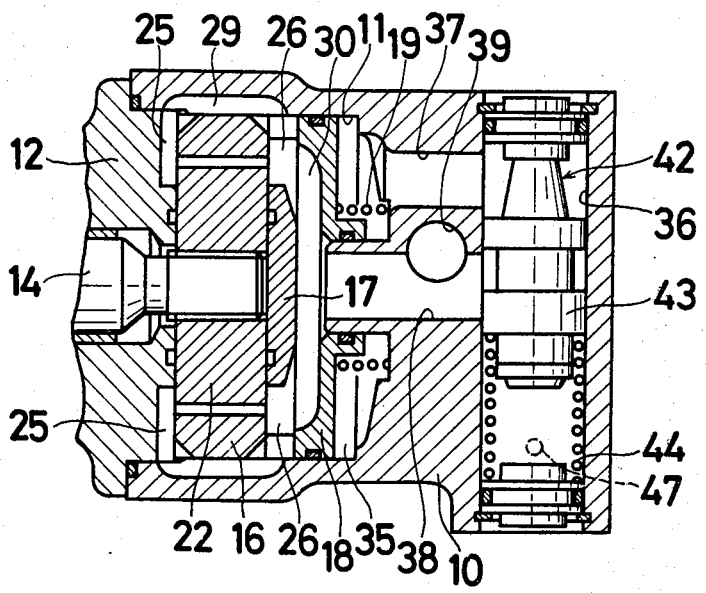
FIG. 5 is a sectional view taken along the lines V—V in FIG. 2.

As shown in FIGS. 2 to 5, the support member side wall 12*a* and the pressure plate 17 are respectively formed with inlet ports 25 and 26 opening to inlet areas of the pump chambers 23 and further with outlet ports 27 and 28 opening to outlet areas of the pump chambers 23. The inlet ports 25, 26 and the outlet ports 27, 28 are alternately disposed with an angular distance of approximate 90 degrees, as shown in FIG. 3. The inlet ports 25 and 26 are in fluid communication with each other through arc-shaped grooves 29 formed in the pump body 10. The inlet ports 26 formed in the pressure plate 17 with angular separation of 180 degrees are fluidically communicated with a low pressure hole 38 formed in the pump body 10 through a low pressure cavity 30, which is formed so as to extend in a radial direction at an abutting or contact portion between the pressure plate 17 and the subplate 18, as shown in FIGS. 4 and 5. The radially outer portions of the low pressure cavity 30 are gradually curved in a direction of rotation of the pump rotor 22, as indicated by an arrow in FIG. 4, to open into the inlet ports 26. The low pressure hole 38 is formed in the pump body 10 in coaxial relationship with the inner bore 11 and is in fluid communication through a vertical intake hole 39 with a reservoir 50, which is mounted on the pump body 10 by the use of a bracket 51. The outlet ports 28 formed on the pressure plate 17 are in fluid communication through outlet recesses 32 extending through the subplate 18 with a pressure chamber 35 defined between the subplate 18 and the pump body 10.

Figure 6:
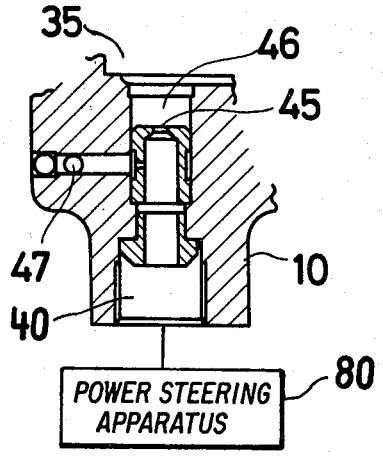
FIG. 6 is a sectional view taken along the lines VI—VI in FIG. 1.

Referring to FIGS. 1 and 6, a discharge port 40 is formed in the pump body 10 and is in communication with the pressure chamber 35 through a passage 46 into which a throttle element or orifice 45 is provided for causing pressure difference thereacross.

Referring to FIG. 5, there is shown a flow volume control valve 42 for controlling a flow volume of pressurized fluid delivered from the discharge port 40 to a power steering apparatus. The control valve 42 comprises a valve spool 43 which is slidably received in a valve bore 36 formed in the pump body 10 to intersect with the low pressure hole 38. One end of the valve bore 36 is in communication with the pressure chamber 35 through a passage 37 formed in the pump body 10. The other end of the valve bore 36 is in communication with the downstream of the orifice 45 through a passage 47 formed in the pump body 10, as shown in FIGS. 1 and 6. A spring 44 is interposed in the other end of the valve bore 36 to urge the valve spool 43 toward the one end of the valve bore 36 to thereby close fluid communication between the low pressure hole 38 and the pressure chamber 35 through the passage 37. Accordingly, the flow volume of pressure fluid delivered from the discharge port 40 through the orifice 45 to the power steering apparatus 80 is controlled to be always constant by the valve spool 43 which controls the extent of communication between the low pressure hole 38 and the pressure chamber 35 through the passage 37 and the other end of the valve bore 36 so as to maintain the pressure difference across the orifice 45 constant.

In operation, when the pump rotor 22 is drivingly rotated together with the drive shaft 14 by an automotive engine, working fluid is sucked from the reservoir 50 into the inlet areas of the pump chambers 23 through intake hole 39, low pressure hole 38, low pressure cavity 30, arc-shaped grooves 29 and inlet ports 25, and 26. The working fluid pressurized at the outlet areas of the pump chambers 23 is delivered to the power steering apparatus 80 through outlet ports 28, outlet recesses 32, pressure chamber 35, passage 46, orifice 45 and discharge port 40. A part of the working fluid delivered to the outlet ports 28 is conducted to the radial slots 22*a*, so that the vanes 21 are pressed upon the cam surface 20 of the cam ring 16 with the pump rotor 22 balancing in the axial direction. Furthermore, the pressurized working fluid within the pressure chamber 35 causes the pressure plate 17 to be pressed against the cam ring 16 through the subplate 18.

The flow rate of the working fluid delivered from the pressure chamber 35 is proportional to the rotational speed of the pump rotor 22, namely to the engine rotational speed. When the flow rate is increased with an increase of the engine rotational speed, the pressure at the upperstream of the orifice 45 is raised with the result that the spool valve 43 is moved downwardly, as viewed in FIG. 5, against the force of the spring 44 so as to open the communication between the one end of the valve bore 36 and the low pressure hole 38. Therefore, a part of the working fluid flowing into the one end of the valve bore 36 is thus bypassed into the low pressure hole 38, and the bypassed flow joins the flow from the intake hole 39 to be conducted to the inlet ports 26 through the low pressure cavity 30. Since the low pressure cavity 30 is gradually curved at its radially outer portions in a rotational direction of the pump rotor 22, the low pressure flow in the radial direction in the low pressure cavity 30 is gradually changed into the flow in the rotational direction of the pump rotor 22 and then sucked into the inlet ports 26. Accordingly, suction loss of the bypassed fluid from the low pressure cavity 30 to the inlet ports 26 is extremely reduced, and thus, the bypassed fluid which is increased in proportion to the increase of the pump rotational speed is effectively conducted to the inlet ports 26, which contributes to reduction of pulsating flow. Such control of the bypass flow by the valve spool 42 permits the pressure difference across the orifice 45 to be maintained constant, whereby the working fluid is delivered from the discharge port 40 to the power steering apparatus always at a constant flow rate.

Obviously, numerous modifications and variations of the present invention are possible in light of the above teachings. It is to be understood, therefore, that within the scope of the appended claims, the invention may be practiced otherwise than as specifically described herein.

What is claimed as new and desired to be secured by Letters Patent of the United States is:

1. A hydraulic pump for use in a power steering apparatus comprising:

a pump body having an inner bore;

a support member fixedly inserted into one open end of said inner bore of said pump body so as to constitute a pump housing;

a cam ring received in said inner bore in contact relationship with one side wall of said support member and having an internal cam bore;

a drive shaft rotatably carried by said support member through a pair of bearings and extending into said internal cam bore in coaxial alignment with the axis of the center of symmetry of said internal cam bore;

a pump rotor carried on said drive shaft for integral rotation therewith and received in said internal cam bore for defining a pump chamber;

a plurality of vanes radially slidably received in said pump rotor for contacting said internal cam bore;

a pressure plate received in the inner bore of said pump body in contact relationship with said cam ring for defining inlet port means fluidically communicated with an inlet area of said pump chamber and outlet port means fluidically communicated with an outlet area of said pump chamber;

a subplate received in the inner bore of said pump body in contact relationship with said pressure plate for defining at a contact portion with said pressure plate a low pressure passage extending in a radial direction and communicated with said inlet port means;

said pump body being formed with a low pressure hole in coaxial relationship with said internal cam bore and communicated at one end thereof with said low pressure passage;

said pump body being formed with a vertical intake hole communicated with the intermediate of said low pressure hole;

a pressure chamber between said subplate and said pump housing wherein said pressure chamber is fluidically communicated with said outlet port means of said pressure plate through said subplate;

a spring interposed within said pressure chamber for urging said subplate, pressure plate and cam ring toward the one side wall of said support member;

said pump body being formed with a discharge passage in parallel relationship with said low pressure hole and communicated at one end thereof with said pressure chamber and at the other end thereof with said power steering apparatus;

said pump body being formed with a horizontal valve bore in perpendicular relationship and communicated with said low pressure hole;

said pump body being formed with an outlet passage in parallel relationship with said low pressure hole and communicated at one end thereof with said pressure chamber and at the other end thereof with said valve bore;

a throttle element disposed on said discharge passage through which pressurized fluid from said pressure chamber is discharged to said power steering apparatus; and a flow volume control valve slidably received in said valve bore and responsive to the pressure difference across said throttle element for returning a part of pressurized fluid through said outlet passage, valve bore, low pressure hole and low pressure passage.

2. A hydraulic pump as claimed in claim 1, wherein said low pressure passage is gradually curved at the radially outer portions thereof in a direction of rotation of said pump rotor.

* * * * *